US008100486B2

(12) United States Patent
Veltrop

(10) Patent No.: US 8,100,486 B2
(45) Date of Patent: Jan. 24, 2012

(54) FOOD STORAGE UNIT WITH DRAWER HAVING IMPACT-ABSORBING SEAL

(75) Inventor: Loren Veltrop, Chicago, IL (US)

(73) Assignee: Prince Castle, LLC, Carol Stream, IL (US)

( * ) Notice: Subject to any disclaimer, the term of this patent is extended or adjusted under 35 U.S.C. 154(b) by 220 days.

(21) Appl. No.: 12/501,237

(22) Filed: Jul. 10, 2009

(65) Prior Publication Data

US 2011/0006652 A1 Jan. 13, 2011

(51) Int. Cl.
*A47B 95/00* (2006.01)

(52) U.S. Cl. ..... 312/296; 312/402; 312/333

(58) Field of Classification Search ..... 312/330.1, 312/402, 404, 296, 401, 405, 333; 62/382; 277/644, 645, 921, 650, 651, 916
See application file for complete search history.

(56) References Cited

U.S. PATENT DOCUMENTS 2,553,832 A * 5/1951 Richard ..... 49/484.1
2,807,841 A * 10/1957 Janos ..... 49/478.1
2,958,912 A * 11/1960 Bower et al. ..... 49/478.1
3,159,885 A * 12/1964 Cowles ..... 49/478.1
3,195,360 A * 7/1965 Burnett ..... 74/18.2
3,295,908 A * 1/1967 Dawley et al. ..... 312/303
3,378,957 A * 4/1968 Frehse ..... 49/478.1
3,459,463 A * 8/1969 Nacht ..... 312/352
3,664,716 A * 5/1972 Johnson ..... 384/19
3,679,159 A * 7/1972 Bach et al. ..... 248/562
3,680,941 A * 8/1972 Shanks ..... 312/296
3,897,856 A * 8/1975 Pineau ..... 188/268
4,306,379 A * 12/1981 Linstromberg ..... 49/482.1
4,365,816 A * 12/1982 Johnson et al. ..... 277/392
4,441,726 A * 4/1984 Uhl ..... 277/652
4,447,095 A * 5/1984 Fielding ..... 384/19
4,469,383 A * 9/1984 Losert ..... 312/296
4,589,711 A * 5/1986 Plank ..... 312/265.1
4,617,759 A * 10/1986 Pasqualini et al. ..... 49/478.1
4,644,698 A * 2/1987 Gerdes et al. ..... 49/478.1
4,867,512 A * 9/1989 Wilkins et al. ..... 312/245
5,516,123 A * 5/1996 Eckel ..... 277/637
6,173,533 B1 * 1/2001 Cittadini et al. ..... 49/478.1
6,173,970 B1 * 1/2001 Choudary et al. ..... 277/644
6,227,634 B1 * 5/2001 Cittadini et al. ..... 312/296
6,315,039 B1 * 11/2001 Westbrooks et al. ..... 165/201
6,655,766 B2 * 12/2003 Hodges ..... 312/406.2
6,994,354 B2 * 2/2006 Sakata ..... 277/598
7,004,477 B2 * 2/2006 Sakata et al. ..... 277/612
7,043,886 B1 * 5/2006 Chubb ..... 52/656.4
2002/0184895 A1 * 12/2002 Anderson et al. ..... 62/3.6
2004/0051427 A1 * 3/2004 Cittadini et al. ..... 312/296
2004/0211212 A1 * 10/2004 Wood ..... 62/441
2004/0232626 A1 * 11/2004 Sakata et al. ..... 277/602
2006/0186770 A1 * 8/2006 Lizell ..... 312/228.1
2006/0220328 A1 * 10/2006 Deaver ..... 277/644
2007/0011950 A1 * 1/2007 Wood ..... 49/478.1
2011/0031705 A1 * 2/2011 Peddle et al. ..... 277/650
2011/0232843 A1 * 9/2011 Bowman et al. ..... 156/345.1

* cited by examiner

*Primary Examiner* — Darnell Jayne
*Assistant Examiner* — Hiwot Tefera
(74) *Attorney, Agent, or Firm* — Kelly & Krause, LP; Joseph P. Krause

(57) ABSTRACT

A drawer seal includes a magnetic coupler, a bellows filled or substantially filled with a vibration dampening material and which is affixed to either a drawer or cabinet by a base member. The base member can be embodied as a dart that extends into a hole formed into the drawer or cabinet. A refrigerated food storage cabinet includes a self-closing drawer provided with the drawer seal whereby the drawer is less likely to rebound open.

27 Claims, 4 Drawing Sheets

FOOD STORAGE UNIT WITH DRAWER HAVING IMPACT-ABSORBING SEAL

BACKGROUND

Magnetic door and drawer seals are well known. They provide an almost hermetic seal for doors and drawers used in commercial and consumer refrigerators and freezers.

A typical prior art "magnetic drawer seal," which as used herein should be construed herein to include a magnetic door seal, has a base member affixed to the outermost edge of the drawer front, a flexible air-filled elongated tube or bellows attached to or formed with the base member and an elongated magnet or magnetic strip coupled to, or formed with the bellows. When the magnet or magnetic strip approaches ferrous material on or part of a cabinet, magnetic force holds the drawer closed and urges the bellows material, as well as material surrounding the magnet, against the cabinet face, sealing the cabinet.

While prior art magnetic drawer seals are generally effective, it has been observed that under certain conditions, prior art magnetic drawer seals are unable to hold self-closing drawers closed, when a the drawer moves from an open to closed position. When heavy or heavily-loaded self-closing drawers first strikes a cabinet, the self-closing drawers often bounces off the cabinet containing the cabinet bounces open and stays open. It is believed that the drawer "rebound" or re-opening is caused by a combination factors. Material from which the seal is formed must be flexible; it is therefore likely that the material compresses upon impact and springs back to its original shape creating a force opposite in direction to the magnetic force provided by the magnet. Air inside the bellows is likely compressed by the drawer's impact and expands after the initial impact creating a force that acts against the force provided by the magnet. Regardless of the factors, magnetic door seals that rebound open after they are closed by a drawer closing mechanism waste energy and can also cause wheel-mounted cabinets to roll around on their own. A magnetic drawer seal that seals as prior art seals do but which also prevents self-closing drawer rebound would be an improvement over the prior art.

DETAILED DESCRIPTION

Figure 1:
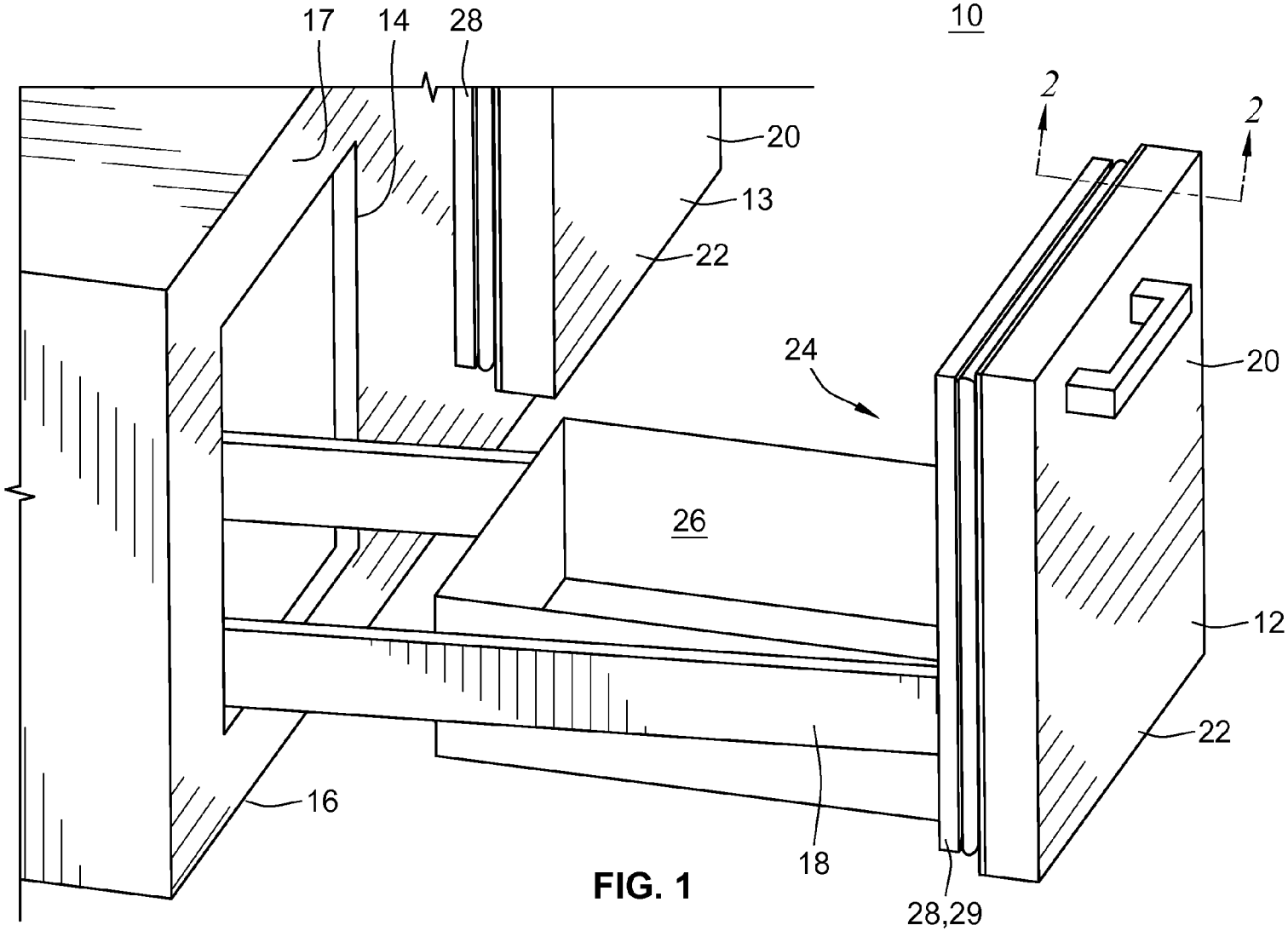
FIG. 1 is a perspective view of a drawer with a seal and a cabinet base unit having two drawers, one of which is shown in an open position.

FIG. 1 is a perspective view of a cabinet 10, such as cabinet-type refrigerator or freezer. The figure shows two drawers, 12 and 13, the first drawer 12 being shown an open position, the second drawer 13 being closed.

As with all drawers used with cabinets, the drawers 12 and 13 slide into and out of openings 14 in the front surface or "face" 17 of the cabinet 16. The drawers 12 and 13 move on drawer slides or glides attached to the side of the drawer box and/or drawer front 20. One slide 18 is visible in the figure. A second drawer slide 18 is on the opposite side of the drawer box 26 and therefore not visible.

The drawers 12 and 13 are self-closing because the slides 18 ride on rollers (inside the cabinet) and inclined, as shown in the figures. When the drawer 12 is pulled open, the inclined slides, which are attached to the drawer, allow the drawer 12 to roll inward through the opening 14 to the closed position. Drawer 13 is shown closed.

As with all drawers, the drawer 12 has a front 20. It also has two sides, a back and bottom that make up the box 26. The front 20 has an outside surface 22 and an inside surface 24. The inside surface 24 of the front 20 faces into the interior of the cabinet 16. The box portion 26 is enclosed within the cabinet 16 when the drawer 12 is in its closed position.

Figure 3C:
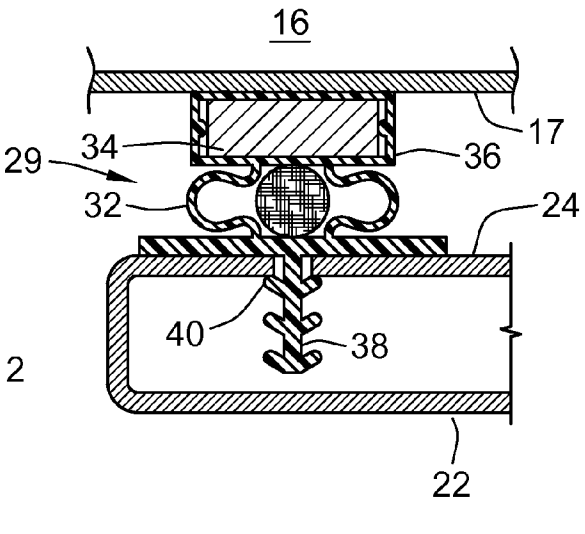
FIG. 3A-3C show the operation of a drawer seal having an impact-absorbing drawer seal having an impact-absorbing, vibration-dampening material inside the seal.
Figure 3B:
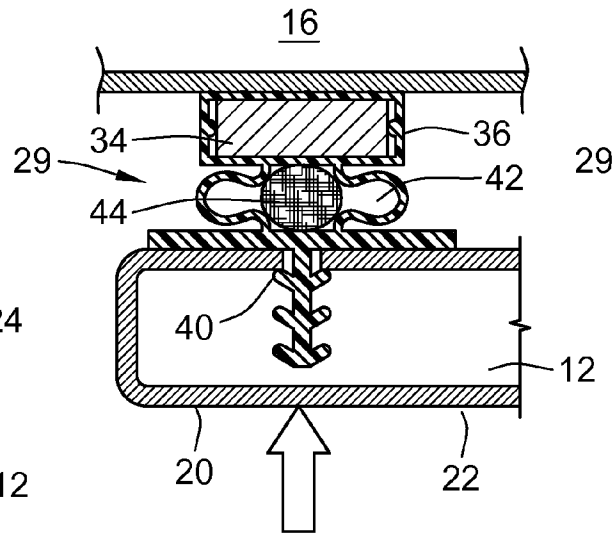
Figure 3A:
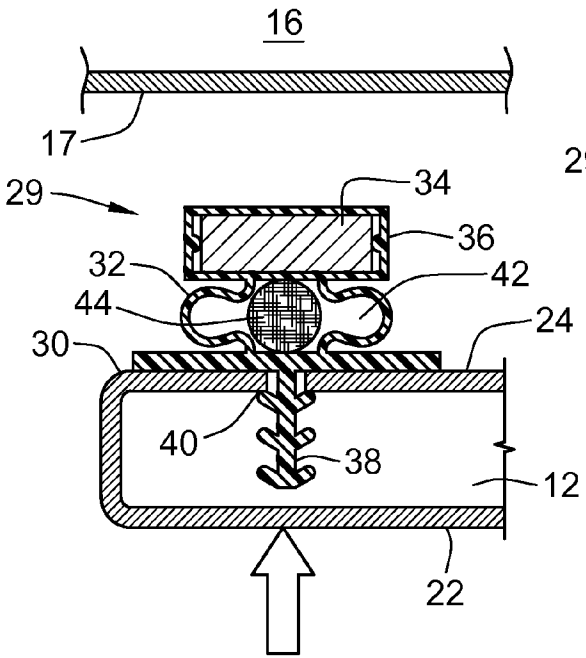

An elongated flexible drawer seal 29 is fastened to the inside surface 24 of the drawer front 20. The drawer seal 29 includes a magnetic portion on the left-most face or surface of the drawer seal 28 facing the front or face surface 17 of the cabinet 16, which is best seen in FIGS. 3A-3C. When the drawer 12 is in its closed position, magnetic force from the magnet in the drawer seal 29 tends to hold the drawer closed and provide a tighter seal than would otherwise be possible using just a flexible gasket material between the drawer inside surface 24 and the cabinet face surface 17.

In order to help understand the operation of the drawer seal shown in FIGS. 3A-3C, FIGS. 2A-2D depict cross-sectional diagrams of the response of a prior art drawer seal 28, when used on a self-closing drawers, such as the one shown in FIG. 1. As used herein, self-closing drawers that rebound are considered to be drawers that re-open after contacting the cabinet when the drawer travels from an open position to its closed position responsive to a drawer self-closing mechanism. Re-opening occurs when the drawer rebounds after initial impact and moves away from the cabinet such that an air gap exists between the seal and the cabinet. Heavy drawers and heavily-loaded drawers can be especially prone to rebound and can weigh as little as ten pounds but with no upper limit on their weight depending on factors that include but which are not limited to drawer closing speed, drawer closer dampening, if any, bellows size and the strength of the magnetic force provided by the magnets. Heavy and/or heavily-loaded drawers are often found in commercial and/or industrial food storage refrigerators and/or freezers.

In FIGS. 2A-2D, the drawer seal 28 is comprised of a base member 30 attached to or formed to have a dart 38. As can be seen in the figures, the dart 38 is sized and shaped to have one or more flexible barbs, which are spaced apart from each other along the length of the dart 38 and which extend radially away from the dart 38. The dart 38 and barbs removably attach the drawer seal 28 to the inside surface 24 of the drawer 12 by driving the dart 38 and barbs through a hole 40 formed along the perimeter of the inside surface 24 of the drawer front 20.

The prior art seal 24 includes a flexible bellows 32, which has a hollow, interior volume 42, usually filled with air. The bellows is made from a flexible material such as vinyl and which is typically compressible. In the embodiment shown, the cross-sectional shape of the bellows 32 is corrugated.

A magnet 34 is enclosed in a jacket 36. The jacket 36 is typically formed from the same material as the bellows 32. In one embodiment, the jacket 36, bellows and base member 30 are formed together as an extrusion.

Figure 2A:
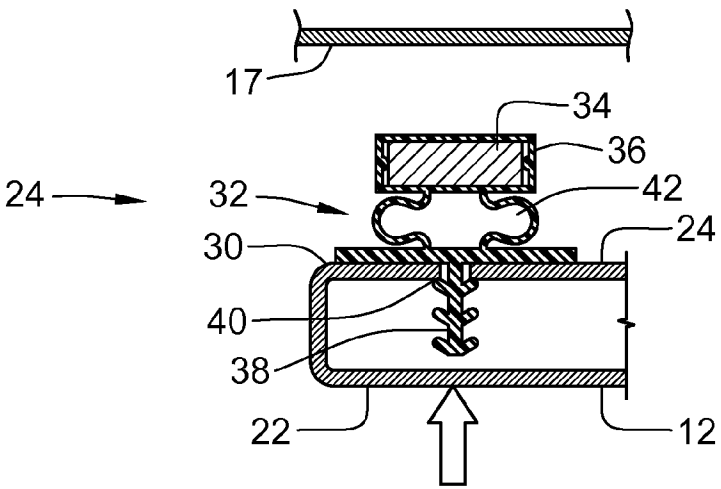
FIG. 2A (PRIOR ART)
FIGS. 2A-2D show a prior-art drawer seal and the drawer seal response to an impact.
Figure 2B:
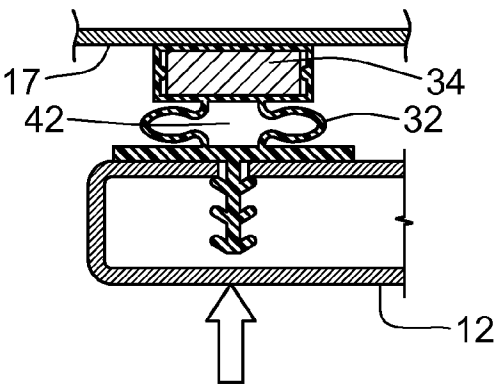
FIG. 2B (PRIOR ART)
Figure 2C:
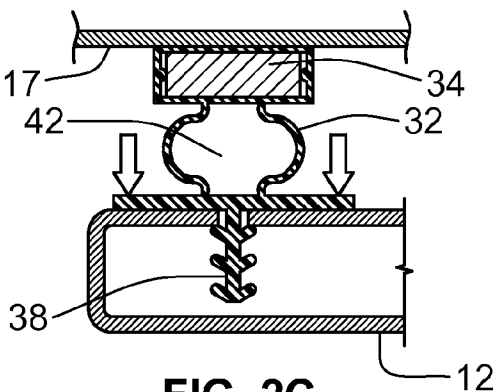
FIG. 2C (PRIOR ART)
Figure 2D:
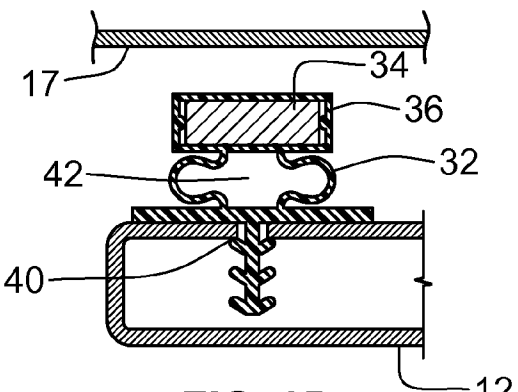
FIG. 2D (PRIOR ART)

In FIG. 2A, the arrow represents the drawer 12 moving toward the face surface 17 of the cabinet 16. In FIG. 2B, momentum acquired by the drawer 12 as it moves from its open to closed positions causes the bellows 32 of the seal 28 to compress or collapse, which of course causes air inside the bellows 32 to also compress. It also compresses the material from which the bellows 32 is formed. After the air and bellows material are compressed, and the drawer's forward momentum stopped, the compressed air and the bellows expansion likely act as an undamped spring, which exerts a force in the opposite direction as represented by the arrows shown in FIG. 2C.

The force exerted on the drawer front 20 by the air compressed inside the bellows 32 and/or the material that forms the seal is believed to cause the drawer to rebound, i.e., spring away from the cabinet 17. If the impact of the drawer 12 on the cabinet 17 is sufficiently strong, the compressed gas inside the seal 28 and the compression and subsequent expansion of the drawer seal material cause the drawer 12 to reverse direction, which also causes the magnet 34 to break free from the drawer front face 17. As a result, the drawer bounces open.

It has been determined that when at least some of the volume inside the bellows 32 is replaced by a non-gaseous, compressible, impact-absorbing material that drawer rebound after closure is reduced or eliminated.

FIG. 3A-3C show a drawer seal 29 comprised of a base member 30 formed with a dart 38 having barbs, to affix or attach the drawer seal 29. As with the seal 28 shown in FIGS. 2A-2D, the drawer seal 29 shown in FIGS. 3A-3C includes a flexible bellows part 32 having a interior volume 42. Unlike the bellows 32 of the prior art seal 28, the bellows of the seal 29 shown in FIGS. 3A-3C has a bellows 32 that is either completely filled or substantially filled with a vibration-dampening material, which is also considered herein to be a vibration dampener 44. As with the prior art drawer seal 28, the drawer seal 29 shown in FIG. 3A-3C has a magnet 36 attached to the bellows 32 opposite the base member 30.

Similar to the seal 28 shown in FIGS. 2A-2D, in a preferred embodiment of the seal 29 shown in FIGS. 3A-3C, the magnet 34 is enclosed within a jacket 36, the material of which is the same as that used to form the bellows 32, the base member 30 and the dart 38. The jacket/bellows material is flexible enough to allow the bellows 32 to deform or "corrugate" in response to a force exerted on the drawer seal 29 by the closure of the drawer 12 against the front surface 17 of the cabinet 16.

In FIG. 3A, the arrow represents the direction of the drawer 12 as it begins to close. In FIG. 3B, it can be seen that the vibration dampening material 44 deforms or is compressed as it absorbs kinetic energy from the self-closing drawer and the drawer front 20.

The dampening material 44 deformation absorbs kinetic energy from the impact of the drawer against the cabinet. That energy is then slowly released by the dampening material 44 after the impact of the drawer 12 against the cabinet 16. The dampened response of the material 44 prevents the drawer 12 from rebounding, over powering the magnetic force provided by the magnet and re-opening the drawer. It also prevents a wheeled cabinet from rolling about when a heavy drawer in such a cabinet closes.

In FIG. 3C, the vibration dampening material 44 is shown as having returned to its original shape which also urges the drawer back and away from the front face 17 of the cabinet 16, albeit by a very small distance. Unlike the action of the prior art seal 28, the magnet 34 enclosed within the jacket 36 retains its grip on ferrous material in the cabinet front surface 17.

By using a solid or semi-solid vibration dampening material inside the bellows of a door or drawer seal, heavy or heavily-loaded self-closing drawers and doors are less likely to rebound open responsive to the undamped spring action of air compressed inside the seal. It has also been observed that when such a drawer seal is used in a cabinet mounted on wheels, the cabinet tends to not roll around on its own when a heavy or heavily-loaded drawer moves from an open to closed position.

Figure 4:
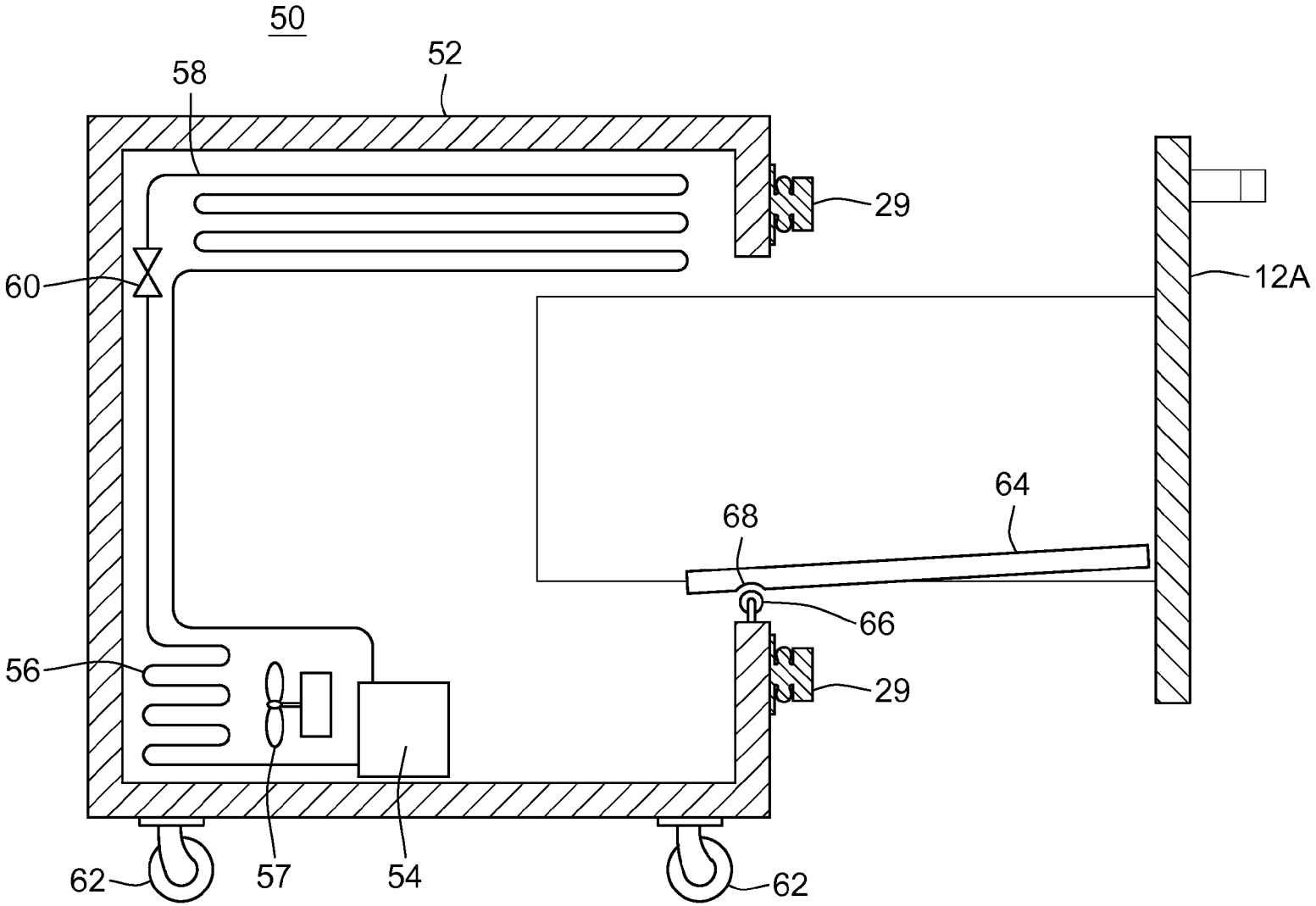
FIG. 4 shows a side view of an alternate embodiment of the cabinet shown in FIG. 1 and which includes both a refrigeration unit, a detent on the drawer slide and an impact absorbing seal attached to the cabinet instead of the drawer.

FIG. 4 shows a side view of a self-closing drawer 12A for use inside a refrigerated food storage cabinet 50. The drawer 12A is self-closing by virtue of inclined drawer slides 64 mounted to the sidewalls of the drawer 12A. The drawer weight causes the drawer 12A to roll downwardly on the slides 64 from its open position as shown in FIG. 4 to a closed position as shown by drawer 13 in FIG. 1.

The drawer slides 64 roll on a roller 66 mounted to the cabinet. A detent 68 in the slides 64 embodied as a depression in the drawer slide 64 holds the drawer 12A in its open position. When the drawer 12A is pushed inwardly and out of the detent 68, the drawer rolls 12A inwardly, i.e., into the refrigerated food storage cabinet 50.

Unlike the drawers shown in FIGS. 1-3, the drawer 12A does not have a drawer seal. In FIG. 4, the drawer seal 29 described above and shown in FIG. 3A-3C is affixed to the cabinet 16 instead of the drawer. A refrigeration unit 51 comprised of a compressor 54, condenser 56, blower 57, evaporator 58 and an expansion valve 60 keep the contents of the drawer 12A cold or frozen. Wheels or rollers 62 allow the refrigerated food storage cabinet 50 to be moved about the floor where it is used.

In a preferred embodiment, the vibration dampener or dampening material 44 is cotton or cotton rope that fills or substantially fills the volume inside the bellows 32. Alternate embodiments of the vibration dampening material include compressible foam rubber, silicone or other vibration dampening solid or semi-solid materials.

While the preferred embodiment of the bellows shown in the figures is considered herein to be corrugated or reminiscent of corrugations, alternate embodiments include seals having bellows the cross-sectional shapes of which can be round, square or rectangular so long as the bellows is able to deform on an impact.

Those of ordinary skill in the art will also recognize that the jacket 36 enclosing the magnet and the bellows 32 are depicted as being formed from the same material. They are therefore considered to be a unitary structure. In an alternate embodiment, the jacket, bellows and base member 30 are all formed as a unitary structure such as happens when they are formed as an extrusion.

The material from which the extrusion is formed is preferably thin and flexible in at least the bellows portion to allow the bellows to be readily deformable upon impact. A preferred embodiment uses vinyl.

The true scope of the invention should not be construed as being limited as to what is described above. The true scope of the invention is described by the appurtenant claims.

What is claimed is:

1. A drawer seal for a cabinet mounted on wheels, the cabinet having at least one self-closing drawer, the self-closing drawer having an open position and a closed position, the self-closing drawer adapted to move from the open position to the closed position by itself, responsive to the weight of the self-closing drawer and to thereby acquire kinetic energy, the drawer impacting the cabinet when it moves from the open position to the closed position and imparting kinetic energy on impact with the cabinet, the drawer seal comprised of:

a flexible bellows at least partially filled with a non-gaseous, compressible kinetic energy-absorbing material; and a magnet coupled to the flexible bellows, the magnet being opposite a base member;

wherein the flexible bellows and the kinetic energy-absorbing material are selected and adapted to eliminate drawer rebound, when the at least one self-closing drawer moves by itself from the open position to the closed position to impact the cabinet.

2. The drawer seal of claim 1, wherein the flexible bellows is comprised of a plastic material capable of corrugating upon impact and thereafter returning to its original shape, the corrugating and return to its original shape absorbing at least some of the kinetic energy imparted to the drawer seal by the self-closing drawer.

3. The drawer seal of claim 1, wherein the kinetic energy-absorbing material is adapted to absorb kinetic energy upon the impact of the self-closing drawer against the cabinet and to prevent the cabinet from rolling on said wheels responsive to the impact.

4. The drawer seal of claim 2, wherein the base member includes a dart configured to attach the drawer seal to at least one of: a self-closing drawer and a cabinet.

5. The drawer seal of claim 1, wherein the magnet is enclosed in a jacket comprised of plastic material, the magnet adapted to provide a force that retains the drawer in the closed position.

6. The drawer seal of claim 1, wherein the kinetic energy-absorbing material is a solid material selected to deform upon impact and slowly release kinetic energy absorbed during impact and return to its original shape.

7. The drawer seal of claim 1, wherein the kinetic energy-absorbing material is comprised of cotton.

8. The drawer seal of claim 1, wherein the kinetic energy-absorbing material is cotton rope.

9. The drawer seal of claim 1, wherein the kinetic energy-absorbing material is compressible foam rubber.

10. The drawer seal of claim 1, wherein the kinetic energy-absorbing material is silicone.

11. The drawer seal of claim 5, wherein the flexible bellows and the kinetic energy-absorbing material are selected and adapted to eliminate drawer rebound and prevent the cabinet on wheels from rolling, when the at least one self-closing drawer impacts the cabinet after moving from the open position to the closed position, said magnet holding the drawer closed.

12. A storage cabinet comprised of: self closing drawer comprised of:

wheels, which are attached to the cabinet and which are adapted to allow the storage cabinet to be rolled on a floor;

a drawer having a front with first and second opposing surfaces, the drawer having a weight and being adapted to be able to move between a closed position whereat the drawer is inside the storage cabinet and the drawer front is against the cabinet, and an open position whereat the drawer is substantially outside the storage cabinet;

a drawer closing mechanism coupled between the drawer and the storage cabinet, the drawer closing mechanism configured to permit the drawer to be moved between the open position and the closed position, the drawer closing mechanism being additionally adapted to allow the drawer to move by itself, from the open position to the closed position and to thereby acquire kinetic energy;

a drawer seal attached to at least one of: the storage cabinet and the first surface of the drawer front, such that the drawer seal is between the first surface of the drawer front and the storage cabinet, the drawer seal comprised of: a base member;

a flexible bellows at least partially filled therein with a non-gaseous, compressible material capable of absorbing kinetic energy acquired by the drawer, when it moves by itself from the open position to the closed position; and a magnet coupled to the flexible bellows wherein said material capable of absorbing kinetic energy, is selected to be able to absorb kinetic energy, when said drawer front impacts said cabinet and to thereby prevent the drawer from rebounding away from the cabinet when the drawer reaches its closed position.

13. The drawer of claim 12, wherein the drawer closing mechanism is comprised of an inclined drawer slide attached to at least one of the drawer and the cabinet.

14. The drawer of claim 13, wherein the inclined drawer slide is comprised of a detent, adapted to hold the drawer in the open position.

15. The drawer of claim 14, wherein the open position is between the detent and the closed position.

16. The drawer of claim 12, wherein the wherein the magnet is adapted to provide a force to hold the drawer in the closed position after the drawer reaches the closed position from its open position.

17. The drawer of claim 12, wherein the material capable of absorbing kinetic energy acquired by the drawer is cotton.

18. The drawer of claim 12, wherein the material capable of absorbing kinetic energy acquired by the drawer is cotton rope.

19. The drawer of claim 12, wherein the material capable of absorbing kinetic energy acquired by the drawer is compressible foam rubber.

20. The drawer of claim 12, wherein the material capable of absorbing kinetic energy acquired by the drawer is silicone.

21. The drawer of claim 12, wherein the material capable of absorbing kinetic energy acquired by the drawer has a substantially circular cross section when it is in an uncompressed state.

22. The drawer of claim 12, wherein the bellows has a corrugated shape when the drawer seal impacts an object.

23. The drawer of claim 13, wherein the base member, bellows and plastic jacket are a unitary structure.

24. A food storage cabinet comprised of:

a) a cabinet on wheels and comprised of a front face;

b) a drawer comprised of:

i) a drawer front having first and second opposing surfaces, the drawer having an open position whereat the drawer is substantially outside the cabinet, and having a closed position whereat the drawer is inside the cabinet and the first surface of the drawer front, is against the front face of the cabinet, the drawer also having a weight;

c) a drawer seal comprised of: a flexible bellows being substantially filled therein with a non-gaseous, compressible vibration dampening material selected to absorb impact energy; and a magnet coupled to the flexible bellows d) a drawer self-closing mechanism configured to enable the drawer to move from the open position to the closed position responsive to the weight of the drawer;

wherein the drawer acquires kinetic energy as it moves from the open position to the closed position and wherein, the drawer seal is adapted to absorb said kinetic energy such that the drawer does not re-open after impact of the first surface of the drawer front with the front face of the cabinet.

25. The food storage cabinet of claim 24, wherein the closing mechanism is comprised of a drawer slide having a detent, adapted to hold the drawer in the open position and wherein the open position is between the detent and the closed position.

26. The food storage cabinet of claim 24, wherein the drawer seal is attached to the drawer.

27. The food storage cabinet of claim 24, wherein the drawer seal is attached to the cabinet.

* * * * *